US006022681A

United States Patent [19]

Hosoya et al.

[11] Patent Number: 6,022,681

[45] Date of Patent: Feb. 8, 2000

[54] METHOD FOR PRODUCING TABULAR SILVER HALIDE GRAIN EMULSION

[75] Inventors: Yoichi Hosoya; Junichi Yamanouchi; Isao Tuyuki; Shigeharu Urabe, all of Kanagawa, Japan

[73] Assignee: Fuji Photo Film Co., Ltd., Kanagawa, Japan

[21] Appl. No.: 09/060,809

[22] Filed: Apr. 16, 1998

[30] Foreign Application Priority Data

Apr. 18, 1997 [JP] Japan ..... 9-101925

[51] Int. Cl.[7] ..... G03C 1/015; G03C 1/035; G03C 1/043; G03C 1/047; G03C 1/053

[52] U.S. Cl. ..... 430/569; 430/567; 430/635; 430/637; 430/638; 430/642

[58] Field of Search ..... 430/567, 569, 430/635, 637, 638, 642

[56] References Cited

U.S. PATENT DOCUMENTS

| | | | |
|---|---|---|---|
| 2,912,343 | 11/1959 | Colins et al. | 430/550 |
| 3,801,326 | 4/1974 | Claes | 430/569 |
| 5,051,350 | 9/1991 | Terai et al. | 430/569 |
| 5,213,772 | 5/1993 | Ichikawa et al. | 422/245 |
| 5,439,787 | 8/1995 | Yamanouchi et al. | 430/567 |
| 5,508,160 | 4/1996 | Maskasky | 430/567 |
| 5,587,281 | 12/1996 | Saitou et al. | 430/567 |
| 5,595,863 | 1/1997 | Yamanouchi et al. | 430/567 |
| 5,652,089 | 7/1997 | Saitou | 430/567 |
| 5,712,083 | 1/1998 | Hosoya et al. | 430/567 |

FOREIGN PATENT DOCUMENTS 0 533 152 A1 3/1993 European Pat. Off. ..... G03C 1/005

OTHER PUBLICATIONS

Aldrich Handbook of Fine Chemicals, 1998–1999, pp T557–T563.

*Primary Examiner*—Mark F. Huff
*Attorney, Agent, or Firm*—Sughrue, Mion, Zinn, Macpeak & Seas, PLLC

[57] ABSTRACT

A method for producing a light-sensitive silver halide photographic emulsion is disclosed, comprising (a) a step of forming silver halide grain nuclei containing twin grain nuclei in a dispersion medium solution, (b) a step of ripening said grain nuclei to preferentially remain tabular grain nuclei, and (c) a step of growing said tabular grain nuclei into tabular grains to form a tabular silver halide grain, wherein in step (a), a silver halide nucleus having a chloride content of 10 mol % or more based on the amount of silver contained in the nucleus is formed, and the tabular silver halide grain obtained through steps (a), (b) and (c) has a Br content of 50 mol % or more based on the total silver amount.

10 Claims, 2 Drawing Sheets

METHOD FOR PRODUCING TABULAR SILVER HALIDE GRAIN EMULSION

FIELD OF THE INVENTION

The present invention relates to a method for producing a silver halide grain emulsion, more specifically, the present invention relates to a method for producing a photographic silver halide tabular grain emulsion.

BACKGROUND OF THE INVENTION

A silver halide grain containing two or more parallel twin planes has a tabular form (hereinafter referred to as a "tabular-grain"). The tabular grain has the following photographic characteristics:

1) the tabular grain has a large surface area ratio to the volume (hereinafter referred to as a "specific surface area") and therefore a large amount of a sensitizing dye can be adsorbed on the surface thereof. As a result, the tabular grain exhibits a relatively high spectral sensitization sensitivity;
2) when an emulsion containing tabular grains is coated and dried, the grains are arrayed in parallel to the support surface and the light scattering due to grains is reduced to thereby improve sharpness and resolution; further, this array of grains provides advantageousness in that the thickness of a coating layer can be reduced and thereby the sharpness can be improved;
3) because of the large specific surface area, the development rate can be increased; and
4) the tabular grain has a strong covering power, and therefore, savings of silver can be attained.

Thus, the tabular grain has many advantageous properties and therefore, has been conventionally used for commercially available high-sensitivity light-sensitive materials.

JP-A-58-113926 (the term "JP-A" as used herein means an "unexamined published Japanese patent application"), JP-A-58-113927 and JP-A-58-113928 discloses an emulsion grain having an aspect ratio of 8 or more. The term "aspect ratio" as used herein means a ratio of the diameter to the thickness of a tabular grain. The term "diameter of a grain" as used herein means a diameter of a corresponding circle having an area equal to the projected area of a tabular grain (hereinafter referred to as a "projected area diameter"). The thickness is shown by a distance between two parallel main planes constituting a tabular grain.

As the aspect ratio is larger, the tabular grain has a larger specific surface area and the advantageous properties of the tabular grain are more extensively used. In order to increase the aspect ratio, various attempts have been made to reduce the thickness of the tabular grain. JP-B-5-12696 (the term "JP-B" as used herein means an "examined Japanese patent publication") discloses a method for preparing a tabular grain having a small thickness using gelatin after invalidation of the methionine groups in the gelatin by hydrogen peroxide or the like, as a dispersion medium. JP-A-8-82883 discloses a method for preparing a thin tabular grain using gelatin after invalidation of the amino groups and methionine groups, as a dispersion medium. Further, U.S. Pat. No. 5,380,642 and JP-A-8-292508 disclose a method for preparing a thin tabular grain using a synthetic polymer as a dispersion medium.

Hitherto, various attempts have been made to achieve monodispersion of tabular grains and several techniques therefor are disclosed in, for example, JP-A-52-153428, JP-A-55-142329, JP-A-51-39027, JP-A-61-112142 and French Patent 2,534,036. Also, JP-A-63-11928, JP-A-63-151618 and JP-A-2-838 disclose monodisperse tabular grains containing hexagonal tabular grains. It is described in their publications that the hexagonal tabular grain is different from the triangular tabular grain, and is a monodisperse tabular grain where the tabular grain having two parallel twin planes occupies 99.7% of the entire projected area of the tabular grain and has the coefficient of variation in the circle-corresponding diameter of 10.1%. However, the tabular grains having a small thickness and a large aspect ratio cause a problem that the projected area diameter has a broad distribution and a monodisperse emulsion can be difficultly obtained.

On the other hand, U.S. Pat. Nos. 5,147,771, 5,171,659, 5,147,772, and 5,147,773 and European Patent 514,742A disclose a method for preparing monodisperse tabular grains by allowing the presence of a polyalkylene oxide block copolymer at the nucleation, where the coefficient of variation in the circle-corresponding diameter of the monodisperse tabular grains is 4.7%. JP-A-7-28183 and JP-A-7-98482 also disclose a method for preparing monodisperse tabular grains using a synthetic polymer. These techniques have successfully realized small thickness and excellent monodispersibility in the AgBr system, but in the AgBrI system, it is still difficult to achieve both the monodispersibility and decrease of thickness of tabular grains.

To overcome this problem, in Japanese Patent Application No. 8-308123, two or more carboxyl groups are introduced at the chemical modification of the amino group in the gelatin and thereby monodisperse tabular grains having a small thickness can be obtained also in the AgBrI system.

However, as the iodide content increases, the monodispersibility is worsened. In particular, when the iodide content is 5 mol % or more based on the total silver amount, it is difficult to obtain monodisperse tabular grains having a small thickness. If the grain formation is performed at a low pBr so as to reduce the thickness, the dispersibility is worsened and monodisperse tabular grains cannot be obtained.

SUMMARY OF THE INVENTION

An object of the present invention is to provide a method for preparing an emulsion comprising tabular grains having a small thickness (namely, a large aspect ratio) and being monodispersed in distribution of the projected area diameter.

The object of the present invention can be achieved by the following techniques:

(1) a method for producing a light-sensitive silver halide photographic emulsion, comprising: (a) a step of forming silver halide grain nuclei containing twin grain nuclei in a dispersion medium solution; (b) a step of ripening the grain nuclei to preferentially remain tabular grain nuclei; and (c) a step of growing the tabular grain nuclei into tabular grains to form a tabular silver halide grain; wherein in step (a), a silver halide nucleus having a chloride content of 10 mol % or more based on the amount of silver contained in the nucleus is formed, and the tabular silver halide grain obtained through steps (a), (b) and (c) has a Br content of 50 mol % or more based on the total silver amount.

Next, the preferred embodiments in the present invention are described below.

(2) the method for producing a light-sensitive silver halide photographic emulsion as described in (1), wherein the dispersion medium contains gelatin having at least one carboxyl group (—COOH group) newly introduced at the time of chemical modification of the amino group (—$NH_2$ group) in the gelatin;

(3) the method for producing a light-sensitive silver halide photographic emulsion as described in (1) or (2), wherein the dispersion medium contains at least one polymer having a repeating unit represented by formula (1):

$$-(R-O)_n- \quad (1)$$

wherein R represents an alkylene group having from 2 to 10 carbon atoms, and n represents an average number of repeating units ranging from 4 to 200;

(4) the method for producing a light-sensitive silver halide photographic emulsion as described in (3), wherein the polymer having a repeating unit represented by formula (1) is at least one polymer selected from a vinyl polymer having at least one monomer represented by formula (2) as a constituent component and a polyurethane represented by formula (3):

(2)

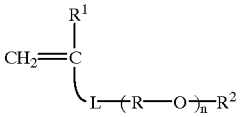

(3)

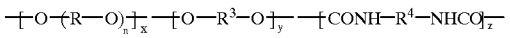

wherein R represents an alkylene group having from 2 to 10 carbon atoms; n represents an average value of the repeating units ranging from 4 to 200; $R^1$ represents a hydrogen atom or a lower alkyl group; $R^2$ represents a monovalent substituent; L represents a divalent linking group; $R^3$ and $R^4$ each represents an alkylene group having from 1 to 20 carbon atoms, a phenylene group having from 6 to 20 carbon atoms or an aralkylene group having from 7 to 20 carbon atoms; x, y and z each represents a weight percentage of respective components, and x is from 1 to 70, y is from 1 to 70, and z is from 20 to 70, provided that x+y+z is 100;

(5) the method for producing a light-sensitive silver halide photographic emulsion as described in (3), wherein the polymer having a repeating unit represented by formula (1) has a polyalkylene oxide block polymer component represented by formula (4) or (5):

(4)

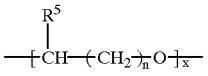

(5)

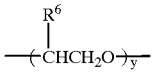

wherein $R^5$ represents a hydrogen atom, an alkyl group having from 1 to 10 carbon atoms or an aryl group having from 6 to 10 carbon atoms; n represents an integer of from 1 to 10, provided that when n is 1, $R^5$ is not a hydrogen atom; $R^6$ represents a hydrogen atom or a lower alkyl group having 4 or less carbon atoms, substituted by a hydrophilic group; and x and y each represents a number of repeating units (number average polymerization degree);

(6) the method for producing a light-sensitive silver halide photographic emulsion as described in (1), (2), (3), (4) or (5), wherein a mixing vessel is provided outside a reaction vessel in which nucleation in step (a) and/or grain growth in step (c) are performed, an aqueous solution of water-soluble silver salt and an aqueous solution of water-soluble halogen salt are supplied to and mixed in the mixing vessel to form silver halide fine grains, and said fine grains are immediately supplied to said reaction vessel to effect nucleation and/or grain growth of silver halide grains in the reaction vessel;

(7) a method for producing a light-sensitive silver halide photographic emulsion as described in (6), wherein the mixing apparatus comprises a closed type stirring tank equipped with a predetermined number of feeding ports for feeding said solutions to be added and stirred and a discharging port for discharging the silver halide fine grain emulsion produced after completion of the stirring process, and a stirring means for controlling the stirring condition of the solution in said stirring tank by rotation-driving at least one pair stirring blade having no rotary shaft protruding the wall of the stirring tank within the stirring tank;

(8) the method for producing a light-sensitive silver halide photographic emulsion as described in (6), wherein the mixing apparatus comprises a closed type stirring tank equipped with a predetermined number of feeding ports for feeding the solutions to be added and stirred and a discharging port for discharging a silver halide fine grain emulsion produced after completion of the stirring process, and a stirring means for controlling the stirring condition of the solution in the stirring tank by rotation-driving a pair stirring blade within the stirring tank, the stirring is performed by two or more rotation-driving pair stirring blades within the stirring tank, and at least two stirring blades are disposed at opposed positions with a spacing in the tank and rotation-driven in the converse directions; and (9) the method for producing a light-sensitive silver halide photographic emulsion as described in (1), (2), (3), (4), (5), (6), (7) or (8), wherein the dispersion medium solution immediately before step (b) or step (c) is adjusted to have an ionic strength of at least 0.2 by the ion other than halogen ion.

KEY TO THE SYMBOLS

Figure 1:
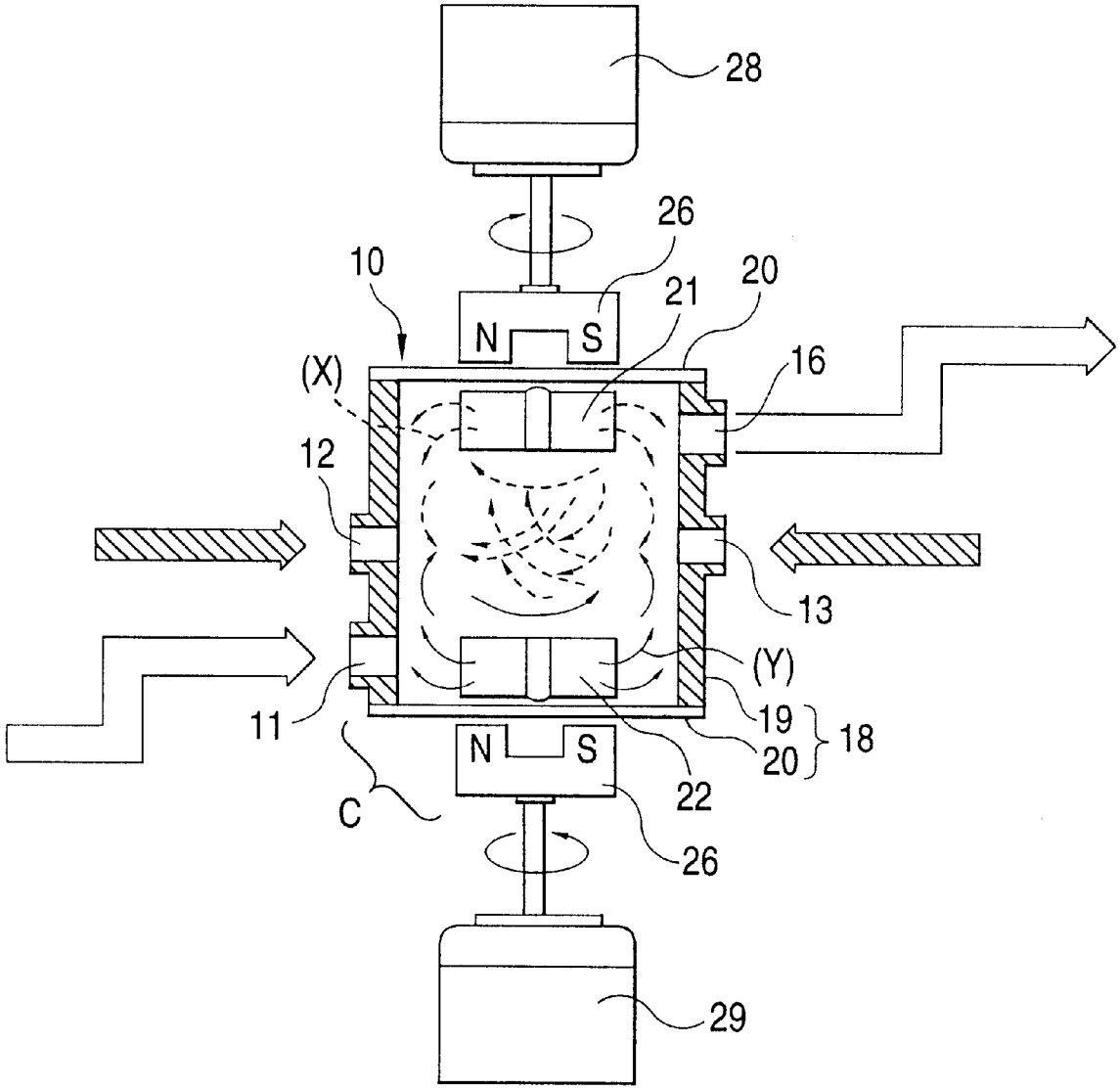
FIG. 1 is a schematic view showing one example of the stirring apparatus for the addition of fine grains.

10: Stirring apparatus
11, 12, 13: Solution-feeding port
16: Solution-discharging port
18: Stirring tank (i.e., Mixing vessel)
19: Stirring tank body
20: Seal plate
21, 22: Stirring blade
26: Outer magnet
28, 29: Motor

DETAILED DESCRIPTION OF THE INVENTION

The silver halide (grain) emulsion prepared by the method of the present invention comprises a dispersion medium and silver halide grains. In a preferred embodiment of the silver halide emulsion, tabular grains having two or more parallel twin planes as the main planes occupy 80% of the entire projected area of the silver halide grains, the tabular grain has a hexagonal shape and the size distribution of the tabular grains is monodisperse.

The term "hexagonal tabular grain" as used in the present invention means a tabular grain where the ratio in the length between two adjacent sides among six sides constituting the hexagonal shape is 2 or less.

The hexagonal tabular grain according to the present invention has a thickness of from 0.01 to 0.2 $\mu$m, preferably from 0.02 to 0.15 $\mu$m.

The hexagonal tabular grains of the present invention are preferably monodisperse. The monodispersibility as used herein is represented by a coefficient of variation in the projected area diameter. The tabular grains of the present invention has monodispersibility of, in terms of the coefficient of variation, 30% or less, preferably from 5 to 25%.

The hexagonal tabular grains of the present invention has an average aspect ratio of from 2 to 60, preferably from 3 to 50. The term "average aspect ratio" as used herein means an average value of aspect ratios of all tabular grains having a diameter of 0.2 $\mu$m or more which are present in the emulsion.

Examples of silver halide composition for use in the present invention include AgBrCl or AgBrClI, but the composition of the shell part resulting from excluding the nucleus containing Cl is, for example, AgBr, AgBrI, AgBrCl or AgBrClI, and the Br content to the total silver amount is from 50 to 100 mo %, preferably from 80 to 100 mol %.

According to one embodiment of the present invention, in the method for producing a light-sensitive silver halide photographic emulsion, comprising (a) a step of forming silver halide grain nuclei containing twin grain nuclei in a dispersion medium solution, (b) a step of ripening said grain nuclei to preferentially remain tabular grain nuclei and (c) a step of growing the tabular grain nuclei into tabular grains to form a tabular silver halide grain, a silver halide nucleus having a chloride content of 10 mol % or more based on the amount of silver contained in the nucleus is formed in step (a) and the tubular silver halide grain obtained through steps (a), (b) and (c) has a Br content of 50 mol % or more based on the total silver amount.

In the present invention, silver chloride is introduced into the nucleus at the nucleation and thereby, the AgBr (or AgBrCl) or AgBrI (or AgBrClI) tabular grains formed after the grain growth-can have a very narrowed distribution of the projected area diameter.

JP-A-5-204069 discloses that by incorporating excess chloride into a dispersion medium solution at the nucleation of silver bromide, the proportion of the tabular grains formed having the {100} face is increased.

This JP-A-5-204069 states that at that time, the excess chloride is not taken in into the silver bromide nucleus, but when the nucleus formed as described in the patent publication is measured by the X-ray diffraction, the nucleus contains about 5 mol % of silver chloride. However, the tabular grains are not monodispersed.

On the other hand, when 10 mol % or more of silver chloride is introduced into the nucleus at the nucleation of silver bromide or silver iodobromide, the tabular grains formed are monodispersed.

In the present invention, the nucleus formed at the nucleation has a Cl content, based on the amount of silver used in the nucleation, of from 10 to 100 mol %, preferably from 20 to 100 mol %. In the case when the final tabular grain after the grain growth is intended to have a thickness of 0.08 $\mu$m or less, the Cl content of the nucleus after the nucleation is preferably from 20 to 60 mol %.

The excess halide present in the dispersion medium at the step (a) may be chloride alone, or bromide, chloride and iodide may be present together. The concentration of the halide is from $3\times10^{-5}$ to 0.1 mol/l, preferably from $3\times10^{-4}$ to 0.01 mol/l.

The content of the chloride in the silver halide solution used for the nucleation is, based on the total amount of halides used for nucleation, from 10 to 100 mol %, preferably from 20 to 80 mol %.

This is described in more detail later in the practical embodiment.

The amino group-modified gelatin for use in the present invention is described below. As a specific means for introducing a —COOH group, a method of modifying the amino group (—$NH_2$) by adding a reaction reagent to gelatin may be used. Specific examples of the reagent include the following, however, the present invention is by no means limited thereto.

(1) Compounds having at least one carboxylic acid (—COOH) and capable of forming at least one acid anhydride in the structure. Examples thereof include phthalic acid anhydride, trimellitic acid anhydride, pyromellitic acid anhydride and mellitic acid anhydride.

(2) Compounds having at least one carboxylic acid and having at least one cyanate group in the structure. Examples thereof include phenyl isocyanate.

(3) Compounds having at least one carboxylic acid and having at least one aldehyde or ketone in the structure.

(4) Compounds having at least one carboxylic acid and at least one imidoester in the structure.

The displacement ratio of the amino group (—$NH_2$ grouop) by the reaction reagent is 60% or more, preferably 80% or more, more preferably 90% or more, based on the —$NH_2$ groups ($\epsilon$-$NH_2$ group) of the lysine residue in the gelatin molecule, and 30% or more, preferably 50% or more, based on all —$NH_2$ groups ($\alpha$-$NH_2$, $\epsilon$-$NH_2$ and guanidyl groups) in the gelatin molecule. Specific examples of the amino group-modification method are described in U.S. Pat. Nos. 2,525,753, 3,118,766, 2,614,928, 2,614,929, JP-B-40-15585, JP-A-8-82883 and *Nippon Shashin Gakkaishi* (*Journal of Japanese Photographic Society*), vol. 58, page 25 (1995).

The polymer for use in the silver halide emulsion of the present invention is described in detail below.

The polymer used in the formation of a tabular grain emulsion of the present invention is a polymer having a repeating unit represented by formula (1):

$$—(R—O)_n— \quad (1)$$

wherein R represents an alkylene group having from 2 to 10 carbon atoms and n represents an average number of the repeating units ranging from 4 to 200.

As long as the polymer has a repeating unit represented by formula (1), it can be preferably used in the formation of the emulsion of the present invention. However, a vinyl polymer having at least one monomer represented by formula (2) as a constituent component or a polyurethane represented by formula (3) is more preferably used, and a vinyl polymer having a repeating unit represented by formula (2) is still more preferably used:

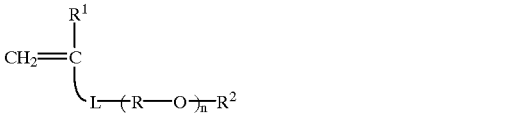

(2)

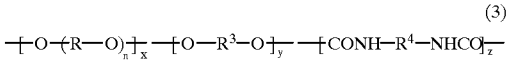

(3)

wherein R represents an alkylene group having from 2 to 10 carbon atoms; n represents an average value of the repeating units ranging from 4 to 200; $R^1$ represents a hydrogen atom or a lower alkyl group (preferably having from 1 to 10 carbon atoms); $R^2$ represents a monovalent substituent; L represents a divalent linking group; $R^3$ and $R^4$ each represents an alkylene group having from 1 to 20 carbon atoms, a phenylene group having from 6 to 20 carbon atoms or an aralkylene group having from 7 to 20 carbon atoms; x, y and z each represents a weight percentage of respective components, and x is from 1 to 70, y is from 1 to 70, and z is from 20 to 70, provided that x+y+z is 100.

Specific examples of the polymers for use in the present invention are set forth below, however, the polymers for use in the present invention are not limited to these polymers. More detailed examples and general description are described in Japanese Patent Application No. 8-113454.

P-1

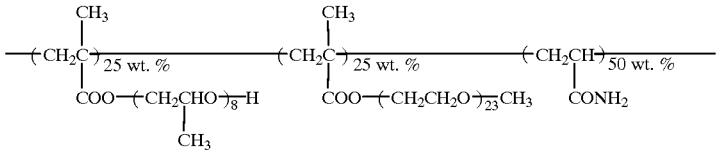

P-2

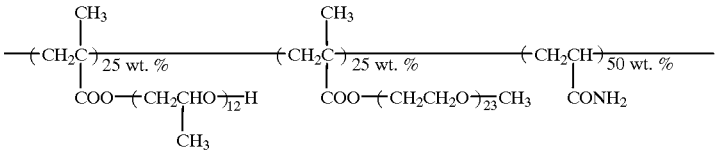

P-3

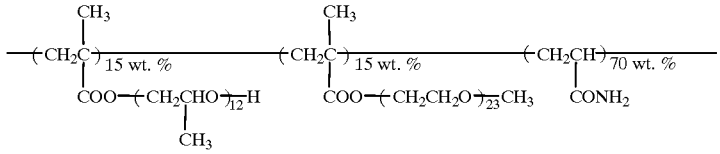

P-4

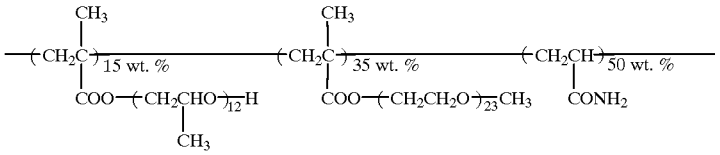

P-5

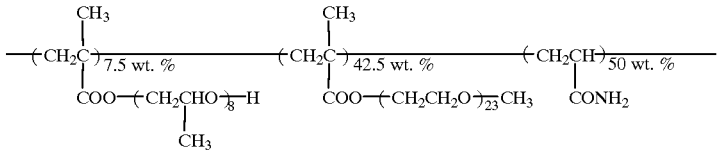

Preferred examples of the polymer having a repeating unit represented by formula (1) of the present invention include polyalkylene oxide block polymers represented by formulae (4) and (5):

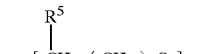

(4)

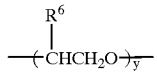

(5)

wherein $R^5$ represents a hydrogen atom, an alkylene group having from 1 to 10 carbon atoms or an aryl group having from 6 to 10 carbon atoms; n represents an integer of from 1 to 10, provided that when n is 1, $R^5$ is not a hydrogen atom; $R^6$ represents a hydrogen atom or a lower alkyl group having 4 or less carbon atoms, substituted by a hydrophilic group; and x and y each represents a number of repeating units (number average polymerization degree).

Specific examples of the block polymers for use in the present invention are set forth below, however, the block polymers for use in the present invention are not limited to these polymers. More detailed examples and general description are described in European Patents 513,722, 513,723, 513,724, 513,735, 513,742, 513,743 and 518,066 and Japanese Patent Application No. 8-113454.

B-1

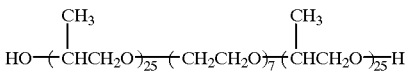

B-2

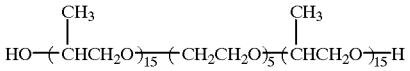

B-3

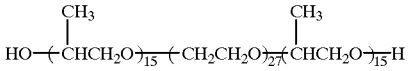

In the case where the water-soluble polymer represented by formula (1) is allowed to be present at the grain formation, it may be present at any stage during the grain formation, however, the polymer is preferably present before the ripening, more preferably before the nucleation. The polymer may be used in an amount of from 0.1 to 50 times (by weight), preferably from 0.1 to 30 times, the amount of the silver nitrate used in the nucleation.

The mixing apparatus for use in the formation of silver halide fine grains used in the present invention is described below, however, the details thereon are described in Japanese Patent Application No. 8-207219.

The mixing apparatus is a closed type stirring apparatus comprising a closed type stirring tank equipped with a predetermined number of feeding port for feeding water-soluble silver salt and water-soluble halogen salt to be stirred and a discharging port for discharging a silver halide fine grin emulsion produced after completion of the stirring process, and a stirring means for controlling the stirring condition of the solution in the stirring tank by rotation-driving at least one pair stirring blade within the stirring tank. The term "pair stirring blade" means a blade having a blade at the symmetrical position to a central axis of rotation (i.e., at both sides of the central axis) when a center of blade is regarded as a central axis of rotation, provided that the pair stirring blade may be a blade having plural blades at the symmetrical position to the central axis of rotation. The stirring means may be at least two rotation-driving pair stirring blades and these blades are rotation-driven within the stirring tank to effect mixing by stirring. More specifically, at least two pair stirring blades are disposed at the opposed positions with a spacing in the stirring tank and rotation-driven in the converse directions. This schematic view is shown in FIG. 1. The (pair) stirring blades each constitutes a structure of having no shaft protruding the tank roll and having a magnetic coupling with an outer magnet disposed outside the tank wall adjacent to each stirring blade. Each the outer magnet dispored outside the tank is rotation-driven by a motor disposed outside the tank to thereby rotate each stirring blade. One of the (pair) stirring blade and the outer magnet which are linked by the magnetic coupling uses a double side bipolar magnet having an N pole face and an S pole face disposed to be parallel to the central axis of rotation and overlapped to interpose the central axis of rotation, and another uses a bilateral bipolar magnet (i.e., U-type magnet) having an N pole face and an S pole face standing abreast at the symmetrical positions to the central axis of rotation on the plane orthogonal to the central axis of rotation.

FIG. 1 is a view showing one embodiment of the mixing apparatus (stirring apparatus 10) according to the present invention.

In FIG. 1, a stirring tank (i.e., a mixing vessel) 18 consists of a stirring tank body 19 having a central axis steering toward the top and bottom directions and seal plates 20 each serving as a tank wall for sealing the top or bottom opening end of the tank body 19. Stirring blades (pair stirring blades) 21 and 22 are disposed at the opposing top and bottom ends of the stirring tank 18 with a spacing and rotation-driven in the converse directions from each other. Stirring blades (pair stirring blades) 21 and 22 each constitutes magnetic coupling C with an outer magnet 26 disposed outside the tank wall adjacent to the stirring blade 21 or 22. That is, the stirring blades 21 and 22 are each linked to respective outer magnets 26 by the magnetic force and can be operated to rotate in the converse directions from each other by rotation-driving each outer magnet 26 by an independent motor 28 or 29.

The stirring tank 18 has solution-feeding ports 11, 12 and 13 for feeding an aqueous silver salt solution, an aqueous halogen salt solution and, if desired, a colloid solution to be stirred and a discharging port 16 for discharging the silver halide fine grain emulsion passed through the stirring process.

In the present invention, when opposed (pair) stirring blades are driven in the stirring tank (i.e., mixing vessel), the rotation speed is 1,000 rpm or more, preferably 3,000 or more. The rotation speeds for rotating (pair) stirring blades in the converse directions may be the same or different.

In the present invention, an ion other than the halogen salt may be added at least during the ripening or before the grain growth. In this case, the ion is preferably added such that the ionic strength of the dispersion medium solution becomes preferably 0.2 or more, more preferably from 0.2 to 2.0, most preferably from 0.3 to 1.0. Preferred ion seeds are described below, however, the present invention is by no means limited thereto. Examples of the ion having a positive electric charge include $H^+$, $Na^+$, $Mg^{2+}$, $Ca^{2+}$, $K^+$, $Ba^{2+}$, $Sr^{2+}$, $Co^2$, $Ni^{2+}$, $Cu^{2+}$, $Zn^{2+}$ and $Al^{3+}$. Among these, divalent or greater valent ions are preferred. Particularly, $K^+$, $Mg^{2+}$, $Ca^{2+}$ and $Ba^{2+}$ are preferred. Examples of the ion having a negative electric charge include $OH^-$, $NO_3^-$, $SO_4^{2-}$, $ClO_4^-$, $BF_4^-$, $BF_6^-$, $N_3^-$, $CN^-$, $C_2O_4^{2-}$, $SCN^-$, $CO_3^{2-}$ and $COO^-$. Among these, $NO_3^-$, $SO_4^{2-}$, $COO^-$ and $CO_3^{2-}$ are particularly preferred.

The ion may supplied by a method of supplying the ion as an inorganic salt aqueous solution. Examples of the inorganic salt include the inorganic salts described in *Kagaku Binran Kiso-Hen II* (*Chemical Handbook, Basic Study*) pp. 453–455, Maruzen, however, the present invention is by no means limited thereto. The inorganic salt aqueous solution may have an appropriate concentration as long as it is not more than the saturated concentration. Other than the above-described method, the ion may be supplied by directly adding the inorganic salt as a powder. In this case, the inorganic salt is added in an amount of giving a value lower than the saturated concentration.

The preparation method of the silver halide emulsion of the present invention is described in more detail below.

The silver halide emulsion of the present invention may be produced through the stages of nucleation→ripening→growth.

Respective stages of nucleation, ripening and growth are described below.

1. Nucleation

The nucleation of the tabular grain is generally performed by a double jet method where an aqueous solution of a silver salt and an aqueous solution of an alkali halide are added to reaction vessel containing an aqueous solution of protective colloid or by a single jet method where an aqueous solution of a silver salt is added to a protective colloid solution containing an alkali halide. Also, a method of adding an aqueous solution of an alkali halide to a protective colloid solution containing a silver salt may be used, if desired. Further, the nucleation of the tabular grain may be performed, if desired, by adding a protective colloid solution, a silver salt solution and an alkali halide solution to a mixer disclosed by JP-A-2-44335 and immediately transferring the mixture to a reaction vessel. Furthermore, the nucleation may also be performed by passing an aqueous solution containing an alkali halide and a protective colloid solution through a pipe and adding thereto an aqueous solution of a silver salt as disclosed by U.S. Pat. No. 5,104,786.

As the protective colloid, gelatin is used. However, other than gelatin, natural polymer or synthetic polymer may also be used. Examples of the gelatin include an alkali-treated gelatin, an oxidation-treated gelatin (methionine content: 40 $\mu$mol/g or less) obtained by oxidizing the methionine group in the gelatin molecule with hydrogen peroxide or the like, an amino group-modified gelatin of the present invention (e.g., phthalated gelatin, trimellited gelatin, succinated gelatin, maleated gelatin, esterified gelatin), and a low molecular weight gelatin (molecular weight: 3000 to 40,000).

Natural polymers are described in JP-B-7-11150, *Research Disclosure,* Item IX, Vol. 176, No. 17643 (December, 1978).

The excess silver salt used in the nucleation of the present invention is $Cl^-$, $Br^-$ or $I^-$. Out of these salts, one salt may be present or a plurality of salts may be present.

The concentration thereof is from $3\times10^{-5}$ to 0.1 mol/l, preferably from $3\times10^{-4}$ to 0.01 mol/l.

The content of chloride added to the halide solution at the nucleation is from 10 to 100 mol %, preferably from 20 to 80 mol %. A protective colloid may also be dissolved in the halide solution.

The temperature at the nucleation is preferably from 5 to 60° C., however, in the case of preparing fine grain tabular grains having an average grain size of 0.5 $\mu$m or less, the temperature is more preferably from 5 to 48° C.

The pH of the dispersion medium is, in the case of using an amino group-modified gelatin, preferably from 4 to 8 and in the case of using other gelatin, preferably from 2 to 8.

2. Ripening

In the nucleation described in item 1 above, fine grains (particularly, octahedral and single twin grains) other than the tabular grains are also formed. Before entering the grain growth stage described in the next item, it is necessary to eliminate grains other than the tabular grains and to obtain nuclei having a shape to grow into tabular grains and having good monodispersibility. To achieve this, as well known, the Ostwald ripening is performed subsequently to the nucleation.

Immediately after the nucleation, the pBr is adjusted and the ripening is performed by elevating the temperature until the ratio of hexagonal tabular grains reaches the highest ratio. At this time, a protective colloid solution may be additionally added. Here, the concentration of the protective colloid in the dispersion medium solutions is preferably 10 wt % or less. The protective colloid used for this additional addition is an alkali-treated gelatin, an amino group-modified gelatin of the present invention, an oxidation-treated gelatin, a low molecular weight gelatin, a natural polymer or a synthetic polymer.

The ripening temperature is from 40 to 80° C., preferably from 50 to 80° C. The pBr is from 1.2 to 3.0. The pH is preferably from 4 to 8 when the amino group-modified gelatin is present, however, it is preferably from 2 to 8 when other gelatin is used.

In order to rapidly eliminate grains other than the tabular grains, a silver halide solvent may be added. The concentration of the silver halide solvent is preferably from 0.3 mol/l or less, more preferably 0.2 mol/l or less. When the resulting emulsion is used as a direct reversal emulsion, the silver halide solvent used is preferably a silver halide solvent used in the neutral or acidic side, such as a thioether compound, than $NH_3$ used in the alkali side.

Almost 100% of the grains remaining after this ripening are the tabular grains.

After completion of the ripening, when the silver halide solvent is not necessary at the next growth stage, the silver halide solvent is removed as follows.

(1) In the case of an alkaline silver halide solvent such as $NH_3$, it is invalidated by adding an acid having a large solubility product to $Ag^+$, such as $HNO_3$.

(2) In the case of a thioether-base silver halide solvent, it is invalidated by adding an oxidizing agent such as $H_2O_2$ as described in JP-A-60-136736.

3. Growth

In the crystal growth stage subsequent to the ripening, the pBr is preferably maintained at from 1.4 to 3.5. When the protective colloid concentration in the dispersion medium solutions before entering the growth stage is low (i.e., 1 wt % or less), protective colloid may be additionally added. At this time, the protective colloid concentration in the dispersion medium solutions is preferably adjusted to from 1 to 10 wt %. The protective colloid used here is an alkali-treated gelatin, an amino group-modified gelatin of the present invention, an oxidation-treated gelatin, a natural polymer or a synthetic polymer. The pH at the growth stage is from 4 to 8 when an amino group-modified gelatin is present, and otherwise, the pH is preferably from 2 to 8. The addition speed of $Ag^+$ or the halogen ion is preferably adjusted to have a crystal growth rate of from 20 to 100%, preferably from 30 to 100%, of the crystal critical growth rate. In this case, the addition rate of silver ion and halide ion is increased with proceeding of the crystal growth and this may be effected either by increasing the addition rate of the aqueous solution of a silver salt and an aqueous solution of a halide salt or by increasing the concentrations of these aqueous solutions as described in JP-B-48-36890 and JP-B-52-16364.

The silver halide grains may also be grown in a reaction vessel by adding an aqueous silver salt solution, a halogen salt solution and if desired, a protective colloid solution to the mixing vessel (i.e., the stirring tank) of the present invention, followed by mixing with stirring, and then immediately transferring the silver halide fine grain emulsion produced to the reaction vessel. At this time, a protective colloid (e.g., gelatin, synthetic polymer) may be dissolved in the aqueous halogen salt solution.

The emulsion layer or other constitution of the silver halide photographic light-sensitive material of the present invention are not particularly limited and various additives may be used, if desired. Examples of the additive which can be added include chemical sensitizers, spectral sensitizers, antifoggants, metallic ion dopants, silver halide solvents, stabilizers, dyes, color couplers, DIR couplers, binders, layer hardening agents, coating aids, thickeners, emulsion precipitants, plasticizers, dimensional stability improvers, antistatic agents, fluorescent brightening agents, lubricants, surface active agents, ultraviolet absorbents, scattering and absorbing materials, hardening agents, adhesion-preventing agents, photographic characteristic improvers (e.g., development accelerators and contrast-increasing agents), couplers which release photographically useful fragments such as developing agents (e.g., development inhibitors and accelerators, bleach accelerators, developing agents, silver halide solvents, toners, layer hardening agents, antifoggants, competing couplers, chemical and spectral sensitizers, desensitizers), image dye stabilizers and autocontrol developing agents. These and the use methods thereof; additionally, hyper-sensitization in the spectral sensitization; the halogen acceptor effect and electron acceptor effect of spectral sensitizing dyes; actions of antifoggants, stabilizers, development accelerators and inhibitors; production apparatuses, reaction apparatuses, stirring apparatuses, coating methods, drying methods, exposure methods (e.g., light sources, exposure atmospheres, exposure techniques) for use in the production of the emulsions of the present invention; layer structures of photographic supports, microporous supports, undercoat layers, surface protective layers, matting agents, interlayers, antihalation layers and AgX emulsion layers; photographic processing agents; and photographic processing methods are described in *Research Disclosure,* vol. 176, Item 17643 (December, 1978), ibid, vol. 184, Item 18431 (August, 1979), ibid, vol. 134, Item 13452 (June, 1975), *Product Licensing Index,* vol. 92, pp. 107–110 (December, 1971), JP-A-58-113926 to 113928, JP-A-61-3134, JP-A-62-6251, *Nippon Kagakukyokai Geppo* (*Journal of Japan Chemistry Association*), pp. 18–27 (December, 1984), JP-A-62-219982, T. H. James, *The Theory of The Photographic Process,* Fourth Edition, Macmillan, New York (1977), and V. L. Zelikman, et al., *Making and Coating Photographic Emulsion,* The Focal Press (1964).

One or more silver halide emulsion layers of the present invention may be provided on a support together with other emulsions, if desired. The layers may be provided not only on one side of the support but also on both sides thereof. Further, emulsions having different color sensitivities may be formed one on another.

The silver halide emulsion of the present invention may be used for black-and-white silver halide photographic light-sensitive materials (e.g., X-ray light-sensitive materials, lithographic light-sensitive materials, negative films for black-and-white photographing) and color photographic light-sensitive materials (e.g., color negative films, color reversal films, color papers). In addition, the silver halide emulsions of the present invention may be used for diffusion transfer light-sensitive materials (e.g., color diffusion transfer elements, silver salt diffusion transfer elements) and heat-developable light-sensitive materials (both black-and-white and color).

The present invention is described in greater detail below by referring to the Examples, however, the embodiments of the present invention should not be construed as being limited thereto.

EXAMPLE 1

Grain formation was performed as follows using the methods (a) to (j) shown in Table 1A to obtain Samples (101) to (110). Samples (101) and (102) are Comparative Examples and others are the sample of the present invention.

One liter of a dispersion medium solution (pH=5) containing a halogen salt in an amount shown in Table 1A and 0.5 g of low molecular weight gelatin (molecular weight: 15,000) was maintained at 40° C. in a reaction vessel. While stirring this solution, 20 ml of a 0.29 mol/liter silver nitrate solution and 20 ml of a 0.29 mol/liter halogen salt solution (shown in Table 1A) were added thereto over 40 seconds by the double jet method. After the addition, 10% KBr was added in an amount shown in Table 1A, and the temperature of the resulting dispersion medium solution was elevated to 75° C. over 15 minutes. When 15 minutes was passed after the elevation of the temperature, a dispersion medium solution containing 35 g of oxidation-treated gelatin and 250 ml of water was newly added. At this time, the pH was adjusted to 6. Thereafter, 734 ml of a 1.2 mol/liter silver nitrate solution was added at an accelerated flow rate. During this addition, the pBr was kept at 2.64 by simultaneously adding a mixed solution of KBr and KI (I: 5 mol %).

Figure 2:
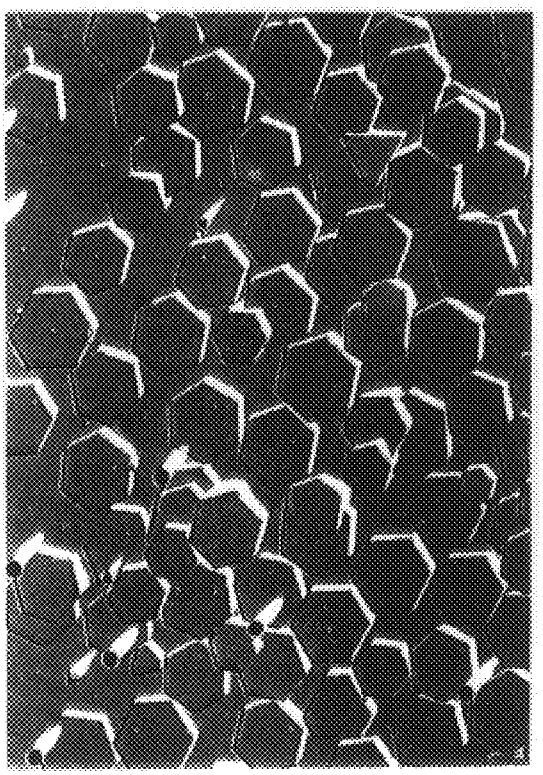
FIG. 2 is an electron microphotograph (magnification: 4,200) showing the grain structure of Sample (104) of the present invention obtained in Example 1.
Figure 3:
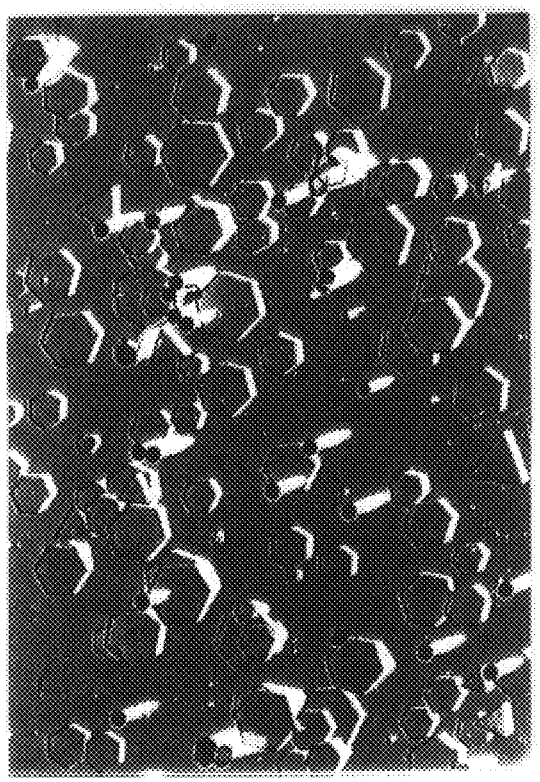
FIG. 3 is an electron microphotograph (magnification: 4,200) showing the grain structure of Sample (101) for comparison obtained in Example 1.

The grains obtained all were AgBrI tabular grains where 90% or more of the entire projected area was occupied by the tabular grains having {111} face as main planes. The grain size and the coefficient of variation in the projected area diameter are shown in Table 1B. An electron microphotograph (magnification: 4,200) of grains of Sample (104) as a representative sample of the present invention in Table 1-B is shown in FIG. 2, and an electron microphotograph (the same magnification as above) of grains of Comparative Sample (101) is shown in FIG. 3. By the comparison of these two photographs, it is seen that the tabular grains of the sample of the present invention have a smaller coefficient of variation in the projected area diameter than that of the comparative sample.

As verified above, by using the method of the present invention, tabular grains having a small coefficient of variation in the projected area diameter can be formed.

TABLE 1A

| | Halogen Salt in Initial Dispersion Medium | | Ratio of Halogen Salts Added at the Nucleation | Amount of 10% KBr added after Nucleation | |
|---|---|---|---|---|---|
| Method | Halogen Salt | Amount (g) | Br:Cl:I | (ml) | Remarks |
| a | KBr | 0.38 | 100:0:0 | 22 | Comparison (AgBr nucleation type) |
| b | NaCl | 0.54 | 100:0:0 | 25.8 | Comparison (type of JP-A-5-204069) |
| c | NaCl | 0.54 | 80:20:0 | 27.2 | |
| d | NaCl | 0.54 | 60:40:0 | 28.6 | |
| e | NaCl | 0.54 | 0:100:0 | 32.8 | |
| f | KBr | 0.38 | 60:40:0 | 24.8 | |
| | NaCl | 0.54 | | | |
| g | KBr | 0.38 | 40:60:0 | 26.2 | |
| | NaCl | 0.54 | | | |
| h | KBr | 0.38 | 60:40:0 | 24.8 | |

TABLE 1A-continued

| Method | Halogen Salt in Initial Dispersion Medium: Halogen Salt | Halogen Salt in Initial Dispersion Medium: Amount (g) | Ratio of Halogen Salts Added at the Nucleation Br:Cl:I | Amount of 10% KBr added after Nucleation (ml) | Remarks |
|---|---|---|---|---|---|
| i | KBr | 0.38 | 40:60:0 | 26.2 | |
| j | KBr | 0.38 | 56:40:4 | 25.0 | |
| | NaCl | 0.54 | | | |

TABLE IB

| Sample No. | Method in Table 1A | Projected Area Diameter (μm) (Coefficient of Variation (%)) | Thickness (μm) | Cl Content in Nucleus (%) | Remarks |
|---|---|---|---|---|---|
| 101 | a | 1.32 (32.1) | 0.09 | 0 | Comparison |
| 102 | b | 1.54 (30.2) | 0.09 | 5 | Comparison |
| 103 | c | 1.98 (19.1) | 0.09 | 20 | Invention |
| 104 | d | 2.05 (18.2) | 0.09 | 40 | " |
| 105 | e | 2.10 (17.8) | 0.10 | 100 | " |
| 106 | f | 1.93 (19.3) | 0.09 | 25 | " |
| 107 | g | 2.01 (18.0) | 0.09 | 45 | " |
| 108 | h | 1.92 (24.1) | 0.09 | 18 | " |
| 109 | i | 2.03 (22.0) | 0.09 | 25 | " |
| 110 | j | 1.73 (21.1) | 0.09 | 24 | " |

EXAMPLE 2

Grain formation was performed as follows using the methods (a), (b), (d) and (g) shown in Table 1A to obtain Samples (201) to (204).

One liter of a dispersion medium solution (pH=5) containing a halogen salt in an amount shown in Table 1A and 0.5 g of low molecular weight gelatin (molecular weight: 15,000) was maintained at 40° C. in a reaction vessel. While stirring this solution, 20 ml of a 0.29 mol/liter silver nitrate solution and 20 ml of a 0.29 mol/liter halogen salt solution (shown in Table 1A) were added thereto over 40 seconds by the double jet method. After the addition, 10% KBr was added in an amount shown in Table 1A, and the temperature of the resulting dispersion medium solution was elevated to 75° C. over 15 minutes. When 15 minutes was passed after the elevation of the temperature, a dispersion medium solution containing 35 g of trimellited gelatin and 250 ml of water was newly added. At this time, the pH was adjusted to 6. Thereafter, 734 ml of a 1.2 mol/liter silver nitrate solution was added at an accelerated flow rate. During this addition, the pBr was kept at 2.64 by simultaneously adding a mixed solution of KBr and KI (I: 5 mol %).

The grains obtained all were AgBrI tabular grains where 90% or more of the entire projected area was occupied by the tabular grains having {111} face as main planes. The grain size and the coefficient of variation in the projected area diameter are shown in Table 2.

TABLE 2

| Sample No. | Method in Table 1A | Projected Area Diameter (μm) (Coefficient of Variation (%)) | Thickness (μm) |
|---|---|---|---|
| 201 | a | 1.43 (24.2) | 0.09 |
| 202 | b | 1.55 (24.1) | 0.09 |
| 203 | d | 2.13 (15.2) | 0.09 |
| 204 | g | 2.20 (16.4) | 0.09 |

EXAMPLE 3

Grain formation was performed as follows using the methods (a), (b), (c), (d), (f) and (g) shown in Table 1A to obtain Samples (301) to (306).

One liter of a dispersion medium solution (pH=5) containing a halogen salt in an amount shown in Table 1A and 0.5 g of low molecular weight gelatin (molecular weight: 15,000) was maintained at 40° C. in a reaction vessel. While stirring this solution, 20 ml of a 0.29 mol/liter silver nitrate solution and 20 ml of a 0.29 mol/liter halogen salt solution (shown in Table 1A) were added thereto over 40 seconds by the double jet method. After the addition, 10% KBr was added in an amount shown in Table 1A, and the temperature of the resulting dispersion medium solution was elevated to 75° C. over 15 minutes. When 15 minutes was passed after the elevation of the temperature, a dispersion medium solution containing 35 g of alkali-treated gelatin and 250 ml of water was newly added. At this time, the pH was adjusted to 6. Thereafter, 1,468 ml of a 0.6 mol/liter silver nitrate solution and 1,468 ml of a 0.61 mol/l KBr and KI mixed solution (I: 5 mol %) containing 5 wt % of low molecular weight gelatin (average molecular weight: 15,000) were added to a mixing vessel (volume: 2 ml) as shown in FIG. 1 at an accelerated flow rate. During this addition, the pBr was kept at 2.64.

The grains obtained all were AgBrI tabular grains where 90% or more of the entire projected area was occupied by the tabular grains having {111} face as main planes. The grain size and the coefficient of variation in the projected area diameter are shown in Table 3.

It is seen from the results of Table 3 that by using the method of the present invention, monodisperse tabular grains can be obtained, however, in order to further reduce the thickness of the tabular grain using the method of the the invention, the methods f and g in Table 1A are more preferred.

TABLE 3

| Sample No. | Method in Table 1A | Projected Area Diameter (μm) (Coefficient of Variation (%)) | Thickness (μm) |
|---|---|---|---|
| 301 | a | 1.72 (39.3) | 0.06 |
| 302 | b | 1.81 (38.7) | 0.06 |
| 303 | c | 2.24 (20.2) | 0.08 |
| 304 | d | 2.31 (19.9) | 0.08 |
| 305 | f | 2.59 (18.9) | 0.06 |
| 306 | g | 2.57 (19.2) | 0.06 |

EXAMPLE 4

Grain formation was performed as follows using the methods (a), (b), (d) and (g) shown in Table 1A to obtain Samples (401) to (404).

One liter of a dispersion medium solution (pH=5) containing a halogen salt in an amount shown in Table 1A and 0.5 g of low molecular weight gelatin (molecular weight: 15,000) was maintained at 40° C. in a reaction vessel. While stirring this solution, 20 ml of a 0.29 mol/liter silver nitrate solution and 20 ml of a 0.29 mol/liter halogen salt solution (shown in Table 1A) were added thereto over 40 seconds by the double jet method. After the addition, 10% KBr was added in an amount shown in Table 1A, and the temperature of the resulting dispersion medium solution was elevated to 75° C. over 15 minutes. When 15 minutes was passed after the elevation of the temperature, a dispersion medium solution containing 35 g of alkali-treated gelatin and 250 ml of water and 200 ml of a 2 mol/l calcium nitrate solution were simultaneously added. At this time, the pH was adjusted to 6. Thereafter, 734 ml of a 1.2 mol/liter silver nitrate solution was added at an accelerated flow rate. During this addition, the pBr was kept at 2.64 by simultaneously adding a mixed solution of KBr and KI (I: 5 mol %).

The grains obtained all were AgBrI tabular grains were 90% or more of the entire projected area was occupied by the tabular grains having {111} face as main planes. The grain size and the coefficient of variation in the projected area diameter are shown in Table 4.

TABLE 4

| Sample No. | Method in Table 1A | Projected Area Diameter (μm) (Coefficient of Variation (%)) | Thickness (μm) |
|---|---|---|---|
| 401 | a | 1.35 (30.8) | 0.09 |
| 402 | b | 1.43 (29.2) | 0.09 |
| 403 | d | 2.19 (17.5) | 0.09 |
| 404 | g | 2.24 (16.9) | 0.09 |

EXAMPLE 5

Grain formation was performed as follows using the methods (a), (b), (d) and (g) shown in Table 1A to obtain Samples (501) to (504).

One liter of a dispersion medium solution (pH=5) containing a halogen salt in an amount shown in Table 1A and 0.5 g of low molecular weight gelatin (molecular weight: 15,000) was maintained at 40° C. in a reaction vessel. While stirring this solution, 20 ml of a 0.29 mol/liter silver nitrate solution and 20 ml of a 0.29 mol/liter halogen salt solution. (shown in Table 1A) were added thereto over 40 seconds by the double jet method. After the addition, 10% KBr was added in an amount shown in Table 1A, and the temperature of the resulting dispersion medium solution was elevated to 75° C. over 15 minutes. Immediately after the elevation of the temperature, 50 ml of a 4% solution of Compound (P-5) of the present invention was added to adjust the pH to 9. After 15 minutes, a dispersion medium solution containing 35 g of oxidation-treated gelatin and 250 ml of water was added. At this time, the pH was adjusted to 6. Thereafter, 734 ml of a 1.2 mol/liter silver nitrate solution was added at an accelerated flow rate. During this addition, the pBr was kept at 2.64 by simultaneously adding a mixed solution of KBr and KI (I: 5 mol %).

The grains obtained all were AgBrI tabular grains where 90% or more of the entire projected area was occupied by the tabular grains having {111} face as main planes. The grain size and the coefficient of variation in the projected area diameter are shown in Table 5.

TABLE 5

| Sample No. | Method in Table 1A | Projected Area Diameter (μm) (Coefficient of Variation (%)) | Thickness (μm) |
|---|---|---|---|
| 501 | a | 1.18 (26.2) | 0.11 |
| 502 | b | 1.22 (26.0) | 0.11 |
| 503 | d | 1.55 (14.9) | 0.11 |
| 504 | g | 1.61 (15.2) | 0.11 |

EXAMPLE 6

Grain formation was performed thoroughly in the same manner as in Example 1. The grains obtained were cooled to 35° C., washed with water by the flocculation method and redispersed at 50° C. The emulsion obtained was subjected to chemical al sensitization and spectral sensitization and used in the fifth layer of the light-sensitive material of Sample 6 (Test No. 101) in Example 3 of JP-A-6-258788. The light-sensitive material was processed in the same manner as in Example 3 of JP-A-6-258788. As a result, good capabilities were obtained.

EXAMPLE 7

Grain formation was performed thoroughly in the same manner as in Example 1. The grains obtained were cooled to 35° C., washed with water by the flocculation method and redispersed at 50° C. The emulsion obtained was subjected to chemical sensitization and spectral sensitization and used as an emulsion of Light-Sensitive Material X in Example 1 of JP-A-6-273866. The light-sensitive material was combined with Screen B and processed in the same manner as in Example 1 of A-6-273866. As a results, good capabilities were obtained.

EXAMPLE 8

Grain formation was performed thoroughly in the same manner as in Example 1. The grains obtained were cooled to 35° C., washed with water by the flocculation method and redispersed at 50° C. The emulsion obtained was subjected to chemical sensitization and spectral sensitization and used in the sixth layer of the light-sensitive material in Example 1 (Test No. 101) of JP-A-2-854. The light-sensitive material was processed in the same manner as in Example 1 of JP-A-2-854. As a result, good capabilities were obtained.

According to the present invention, a silver halide emulsion comprising tabular silver halide grains having a small thickness (a large aspect ratio) and a monodisperse distribution in the projected area diameter can be produced.

While the invention has been described in detail and with reference to specific embodiments thereof, it will be apparent to one skilled in the art that various changes and modifications can be made therein without departing from the spirit and scope thereof.

What is claimed is:

1. A method for producing a light-sensitive silver halide photographic emulsion, comprising:

(a) a step of forming silver halide fine grain nuclei in a dispersion medium solution;

(b) a step of ripening said fine grain nuclei to preferentially eliminate grain nuclei other than tabular grain nuclei; and (c) a step of growing said tabular grain nuclei into tabular grains to form tabular silver halide grains;

wherein in step (a), a silver halide nucleus having a chloride content of 10 mol % or more based on the amount of silver contained in the nucleus is formed, and the tabular silver halide grains obtained through steps (a), (b) and (c) are characterized by: (1) having a Br content of 50 mol % or more based on the total silver amount and (2) having a core portion that does not contain Cl, and wherein 90% or more of the entire projected area of the grains is occupied by tabular grains having a {111} face as main planes.

2. The method for producing a light-sensitive silver halide photographic emulsion as claimed in claim 1, wherein said dispersion medium solution contains gelatin having at least one carboxyl group (—COOH group) newly introduced at a time of chemical modification of an amino group (—$NH_2$ group) in the gelatin.

3. The method for producing a light-sensitive silver halide photographic emulsion as claimed in claim 1, wherein said dispersion medium solution contains at least one polymer having a repeating unit represented by formula (1):

$$-(R-O)_n- \quad (1)$$

wherein R represents an alkylene group having from 2 to 10 carbon atoms, and n represents an average number of repeating units ranging from 4 to 200.

4. The method for producing a light-sensitive silver halide photographic emulsion as claimed in claim 3, wherein the polymer having a repeating unit represented by formula (1) is at least one polymer selected from a vinyl polymer having at least one monomer represented by formula (2) as a constituent component and a polyurethane represented by formula (3):

(2)

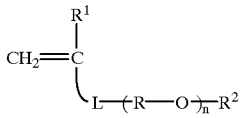

(3)

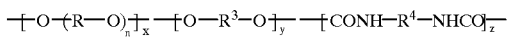

wherein R represents an alkylene group having from 2 to 10 carbon atoms; n represents an average number of repeating units ranging from 4 to 200; $R^1$ represents a hydrogen atom or a lower alkyl group; $R^2$ represents a monovalent substituent; L represents a divalent linking group; $R^3$ and $R^4$ each represents an alkylene group having from 1 to 20 carbon atoms, a phenylene group having from 6 to 20 carbon atoms or an aralkylene group having from 7 to 20 carbon atoms; x, y and z each represents a weight percentage of respective components, and x is from 1 to 70, y is from 1 to 70, and z is from 20 to 70, provided that x+y+z is 100.

5. The method for producing a light-sensitive silver halide photographic emulsion as claimed in claim 3, wherein the polymer having a repeating unit represented by formula (1) has a polyalkylene oxide block polymer component represented by formula (4) or (5):

(4)

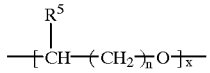

(5)

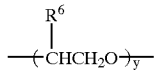

wherein $R^5$ represents a hydrogen atom, an alkyl group having from 1 to 10 carbon atoms or an aryl group having from 6 to 10 carbon atoms; n represents an integer of from 1 to 10, provided that when n is 1, $R^5$ is not a hydrogen atom; $R^6$ represents a hydrogen atom or a lower alkyl group having 4 or less carbon atoms, substituted by a hydrophilic group; and x and y each represents a number of repeating units (number average polymerization degree).

6. The method for producing a light-sensitive silver halide photographic emulsion as claimed in claim 1, wherein a mixing vessel is provided outside a reaction vessel in which nucleation in step (a) and/or grain growth in step (c) are performed, an aqueous solution of water-soluble silver salt and an aqueous solution of water-soluble halogen salt are supplied to and mixed in the mixing vessel to form silver halide fine grains, and said fine grains are immediately supplied to said reaction vessel to effect nucleation and/or grain growth of silver halide grains in said reaction vessel.

7. A method for producing a light-sensitive silver halide photographic emulsion as claimed in claim 6, wherein said mixing vessel comprises a closed stirring tank equipped with feeding ports for feeding said solutions to be added and stirred and a discharging port for discharging the silver halide fine grain emulsion produced after completion of a stirring process, and a stirring means for controlling the stirring of the solution in said stirring tank by rotation-driving at least one pair stirring blade having no rotary shaft protruding from a wall of said stirring tank within said stirring tank.

8. The method for producing a light-sensitive silver halide photographic emulsion as claimed in claim 6, wherein said mixing vessel comprises a closed stirring tank equipped with feeding ports for feeding said solutions to be added and stirred and a discharging port for discharging a silver halide fine grain emulsion produced after completion of a stirring process, and a stirring means for controlling the stirring of the solution in said stirring tank by rotation-driving a stirring blade within said stirring tank, wherein the stirring is performed by at least two rotation-driving pair stirring blades within said stirring tank, and at least two pair stirring blades are disposed at opposed positions within the tank and rotation-driven in converse directions.

9. The method for producing a light-sensitive silver halide photographic emulsion as claimed in claim 1, wherein said dispersion medium solution immediately before step (b) or step (c) is adjusted to have an ionic strength of at least 0.2 by an ion other than a halogen ion.

10. A method for producing a light-sensitive silver halide photographic emulsion as claimed in claim 1, wherein the tabular silver halide grains obtained through steps (a), (b) and (c) are AgBr or AgBrI tabular grains.

* * * * *